US007231783B2

(12) United States Patent
Esslinger et al.

(10) Patent No.: US 7,231,783 B2
(45) Date of Patent: Jun. 19, 2007

(54) OIL CONTROL SYSTEM FOR A REFRIGERATION SYSTEM

(75) Inventors: Steve L. Esslinger, Oak Grove, MN (US); Erik B. Haffner, Ramsey, MN (US)

(73) Assignee: Zero Zone, Inc., North Prairie, WI (US)

( * ) Notice: Subject to any disclaimer, the term of this patent is extended or adjusted under 35 U.S.C. 154(b) by 11 days.

(21) Appl. No.: 11/211,310

(22) Filed: Aug. 25, 2005

(65) Prior Publication Data

US 2006/0042307 A1 Mar. 2, 2006

Related U.S. Application Data

(60) Provisional application No. 60/639,942, filed on Dec. 29, 2004, provisional application No. 60/604,943, filed on Aug. 27, 2004.

(51) Int. Cl.
*F25B 43/02* (2006.01)
*F25B 1/10* (2006.01)

(52) U.S. Cl. ..... 62/468; 62/469; 62/510

(58) Field of Classification Search ..... 62/468, 62/469, 510
See application file for complete search history.

(56) References Cited

U.S. PATENT DOCUMENTS

| | | | | |
|---|---|---|---|---|
| 2,246,244 | A * | 6/1941 | Consley | 62/192 |
| 2,701,684 | A * | 2/1955 | Hirsch | 418/84 |
| 5,094,598 | A * | 3/1992 | Amata et al. | 417/533 |
| 5,321,956 | A * | 6/1994 | Kemp et al. | 62/193 |
| 5,327,997 | A * | 7/1994 | Nash et al. | 184/6.4 |
| 5,444,988 | A * | 8/1995 | Eden | 62/125 |
| 5,911,289 | A * | 6/1999 | Waller | 184/103.2 |
| 6,446,462 | B1 * | 9/2002 | Kiyokawa et al. | 62/469 |

* cited by examiner

*Primary Examiner*—Cheryl Tyler
*Assistant Examiner*—B. Clayton McCraw
(74) *Attorney, Agent, or Firm*—Michael Best & Friedrich LLP

(57) ABSTRACT

A refrigeration system includes a compressor having a compressor housing and operable to compress a flow of refrigerant. A pump is operable to provide a flow of oil to the compressor. A portion of the oil mixes with the flow of refrigerant and the remainder of the oil flows into the compressor housing. A valve is movable between an open position and a closed position. When in the closed position, the valve is operable to inhibit the addition of oil above a predetermined level within the housing.

13 Claims, 5 Drawing Sheets

OIL CONTROL SYSTEM FOR A REFRIGERATION SYSTEM

RELATED APPLICATION DATA

This application claims benefit under 35 U.S.C. Section 119(e) of now abandoned U.S. Provisional Application No. 60/604,943 filed Aug. 27, 2004, and U.S. Provisional Application No. 60/639,942 filed Dec. 29, 2004, both of which are fully incorporated herein by reference.

BACKGROUND

The present invention relates to a compressor and particularly to an oil system for a compressor. More particularly, the present invention relates to an oil system for compressors in parallel or multiplexed applications.

Compressor racks, such as those employed in large supermarket applications, often encounter difficulty in controlling the oil level in a compressor. Thus, it is possible for compressors to overfill with oil. The over full condition occurs when oil returns through a common suction header to different size compressors. This happens regardless of the oil separator efficiency. The oil overfill condition may also take place if a compressor is off for several hours or more. This is the result of normal vapor movement through the compressors discharge valves. Compressors can fail if they are operated with too much oil in the crankcase.

Energy usage penalties are also associated with high oil levels in compressors. For example, compressors with oil levels only ⅜ of an inch over the recommended level can suffer a decrease in efficiency of about four percent. The efficiency decreases due to the elevated power consumption required to pump or agitate the additional quantity of oil. The efficiency loss of each compressor varies with the manufacturer and compressor model in addition to the amount of oil overfill. Maintaining an oil level that is not too high and not too low, regardless of whether a compressor is running or not, will likely increase efficiency and will reduce the likelihood of premature compressor failure.

Compressor oil systems also require a certain type and nature of lubricant to remain miscible with refrigerants commonly used in the industry today. Ester oil is typically used in supermarket compressors and has two main components: carboxylic acid and alcohol. These two components act as cleaning solvents that scrub the inside of the piping and components, thereby loosening abrasive particulate found in the refrigeration system. The suspended particulates precipitate the need for more frequent oil changes, which can be costly. An alternative to changing the oil is to change the compressor more often due to the abrasives in the lubricant. Further, it has been suggested that bearing life can be increased by decreasing the size of the particulates in the lubricant.

SUMMARY

In one embodiment, the invention provides an oil system that utilizes a pump to remove excess oil from a compressor. The pump operates continuously. The removal of oil is accomplished through an oil float assembly, which is a modified version of a standard float. The oil float assembly prevents the system from removing oil lower than an established recommended level of a sight glass. Once removed from the compressor, the oil is pumped though a filter and into an oil reservoir for reuse. Oil continuously enters and exits the compressor for filtration purposes. The invention also provides for the removal of oil slugs before they can damage a compressor.

In another embodiment, the invention provides a refrigeration system includes a compressor having a compressor housing and operable to compress a flow of refrigerant. A pump is operable to provide a flow of oil to the compressor. A portion of the oil mixes with the flow of refrigerant and the remainder of the oil flows into the compressor housing. A valve is movable between an open position and a closed position. When in the closed position, the valve is operable to inhibit the addition of oil above a predetermined level within the housing.

In yet another embodiment, a refrigeration system includes a plurality of compressors that are operable to compress a flow of refrigerant. Each compressor includes a housing and receives a flow of oil. The invention also includes a plurality valves. Each valve is in fluid communication with one of the compressors and defines a float space. Each valve is operable to inhibit the addition of oil above a first predetermined level within the float space. A pump is in fluid communication with each of the valves and is operable to pump oil out of each of the float spaces. The invention also includes a plurality of drain ports. Each drain port is in fluid communication with one of the float spaces and is operable to continuously drain oil from the float space when the oil level exceeds a second predetermined level within the float space.

In another construction, the invention provides a method of controlling the oil level within a plurality of compressors. The method includes providing an oil header, delivering a flow of oil from the oil header to at least one of the plurality of compressors, and draining oil from the plurality of compressors and delivering the oil to the oil header. The method also includes associating a valve with each of the plurality of compressors and moving at least one of the valves in response to an oil level above a first predetermined value to inhibit the addition of oil to the associated compressor.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
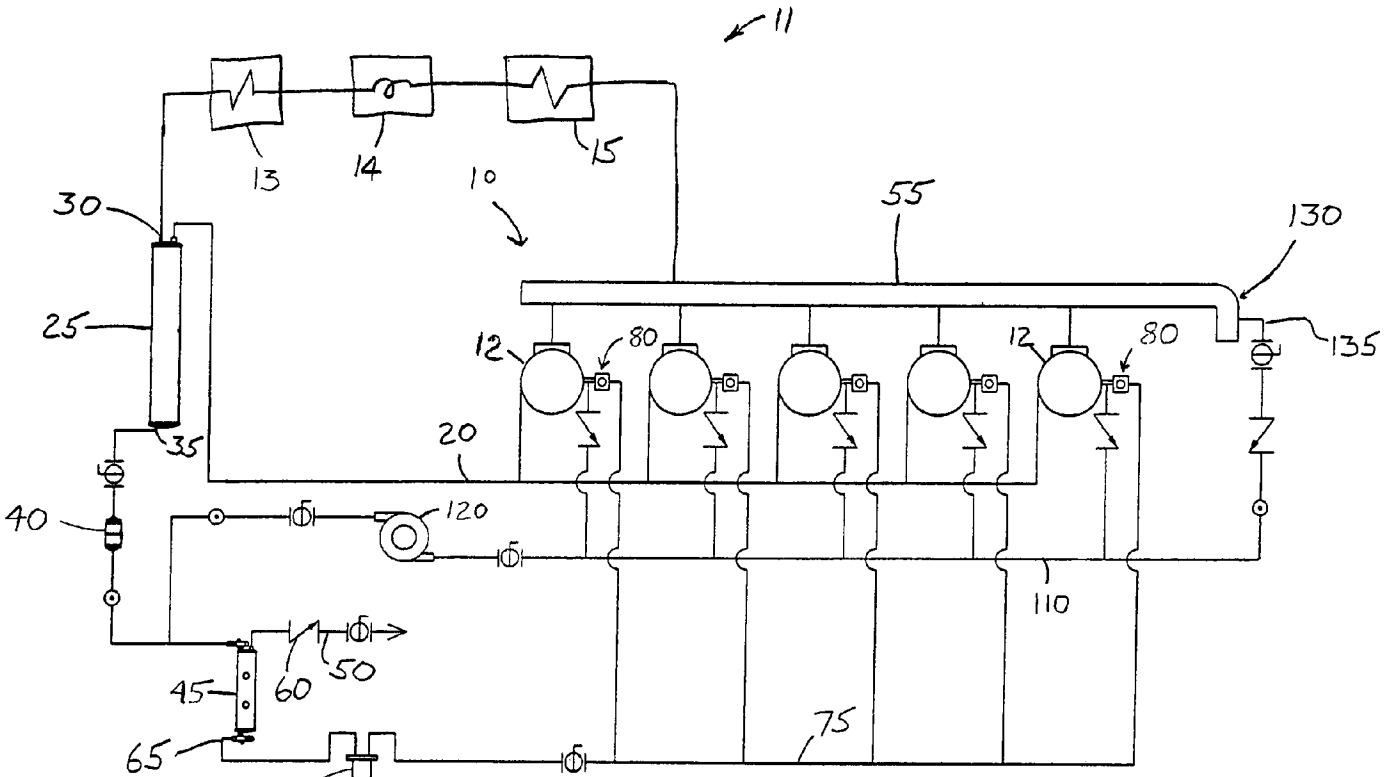
FIG. 1 is a schematic representation of an oil system according to the present invention.
Figure 4:
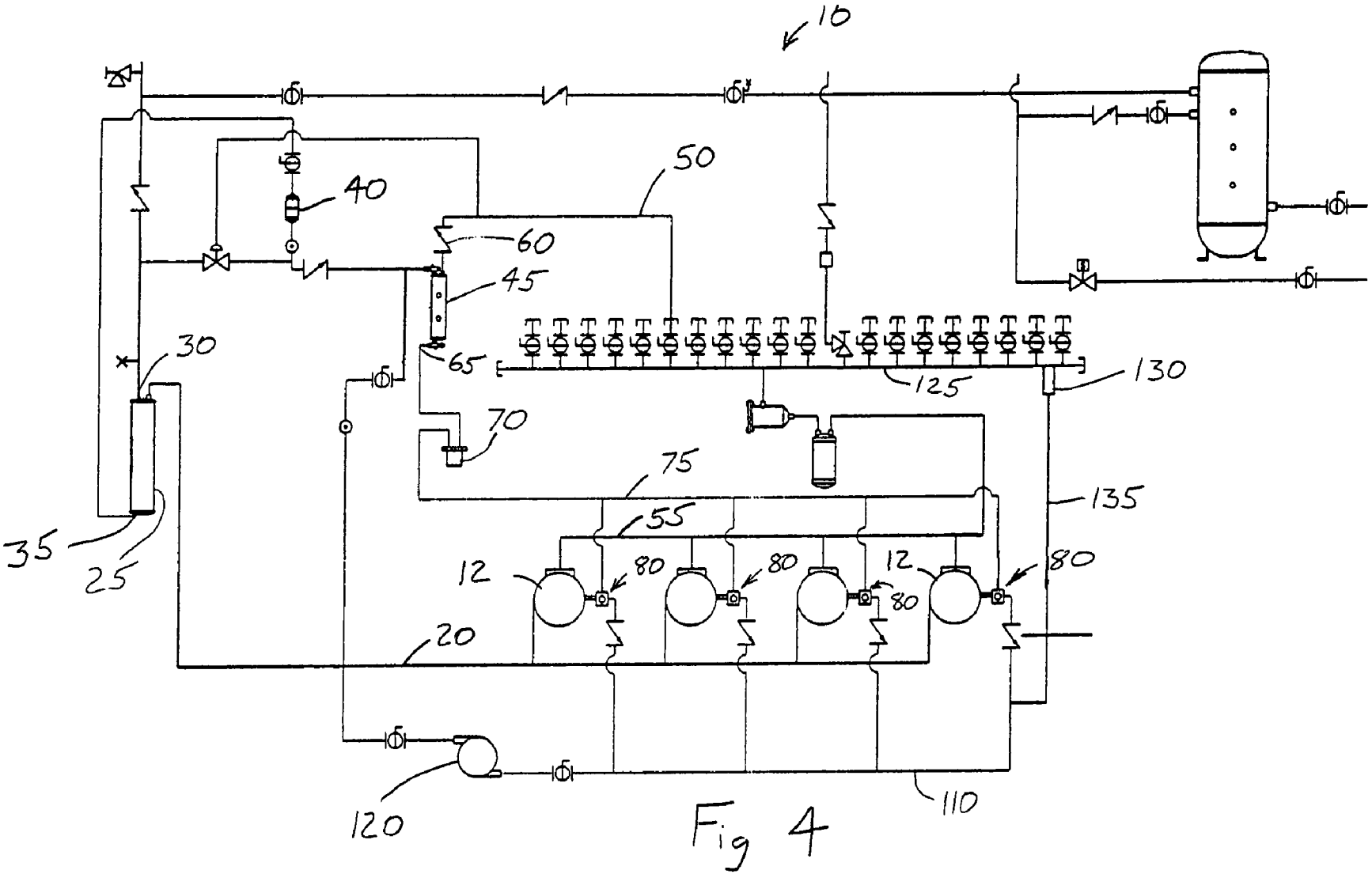
FIG. 4 is a second schematic representation of an oil system according to the present invention.

FIGS. 1 and 4 illustrate an oil system 10 that is well-suited for use in refrigeration systems. Large refrigeration systems 11, such as those employed in supermarkets or cooled warehouses, often employ multiple compressors 12 that are operable to deliver compressed refrigerant to one or more condensers 13, one or more expansion devices 14, and one or more evaporators 15. Refrigeration systems 11 of this type are well known in the art and as such are not discussed in detail. In many constructions, oil flooded compressors 12 of the same or different sizes may be selected to efficiently provide capacity stages. Each compressor 12 includes a compressor housing 16 that contains the oil and a sight glass 18 positioned at a height to allow a visual inspection of the quantity of oil within the compressor housing 16. Typically, the sight glass 18 is positioned such that three eights of the sight glass is filled with oil when the oil is at a normal operating level. Of course other compressors may position the sight glasses differently or may require a different quantity of oil within the sight glass. The oil acts as a sealant between meshing parts within the compressor 12 and also cools and lubricates the moving parts during operation. The oil system described herein cleans and delivers oil to one or several oil flooded compressors 12 to maintain the manufacturers' recommended oil level and improve the efficiency and operating life of the compressors 12 within the refrigeration system 11.

During compressor operation, oil mixes with the refrigerant that is being compressed by the compressor or compressors 12. The oil-refrigerant mixture exits each compressor 12 and flows into a discharge header 20. Before proceeding, it should be noted that the term "header" as used herein is meant to encompass any collection space in a piping system. For example, a single pipe that receives flow from each of the compressors 12 should be considered a header. In constructions that employ a single compressor 12, the discharge pipe also functions as the discharge header. From the discharge header 20, the oil-refrigerant mixture flows to an oil separator 25 that is capable of separating the oil from the compressed refrigerant. The oil separator 25 includes a first outlet 30 that directs the refrigerant to the remainder of the refrigeration system 11 and a second outlet 35 that discharges a flow of oil. The flow of refrigerant passes through the refrigeration system 11 as is known in the art. As such, the refrigeration system 11 will not be described in detail. The flow of oil passes from the oil separator 25 to an oil pre-filter 40 that removes large particulates from the oil to reduce the likelihood of such debris blocking valves or oil lines. The oil pre-filter 40 is connected to an oil reservoir 45 that stores oil for use in the system.

The oil reservoir 45 includes a vent path 50 that extends from the oil reservoir 45 to a refrigerant suction header 55. A differential check valve 60 is positioned within the vent path 50 between the oil reservoir 45 and the refrigerant suction header 55. The differential check valve 60 allows for the venting of excess pressure from the oil reservoir 45 when the pressure differential between the refrigerant suction header 55 and the oil reservoir 45 exceeds a predetermined value.

The oil reservoir 45 also includes an outlet flow path 65 that directs oil from the oil reservoir 45 to an oil filter 70. In one embodiment, the oil filter 70 is capable of removing approximately ninety-nine percent of three micron particulates from the oil. After passing through the oil filter 70, the oil flows into an oil distribution header 75 for distribution to one or more of the compressors 12.

Figure 2:
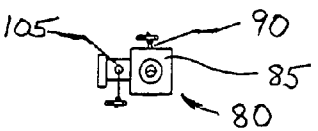
FIG. 2 is a schematic representation of an oil float assembly, as depicted in FIG. 1.
Figure 5:
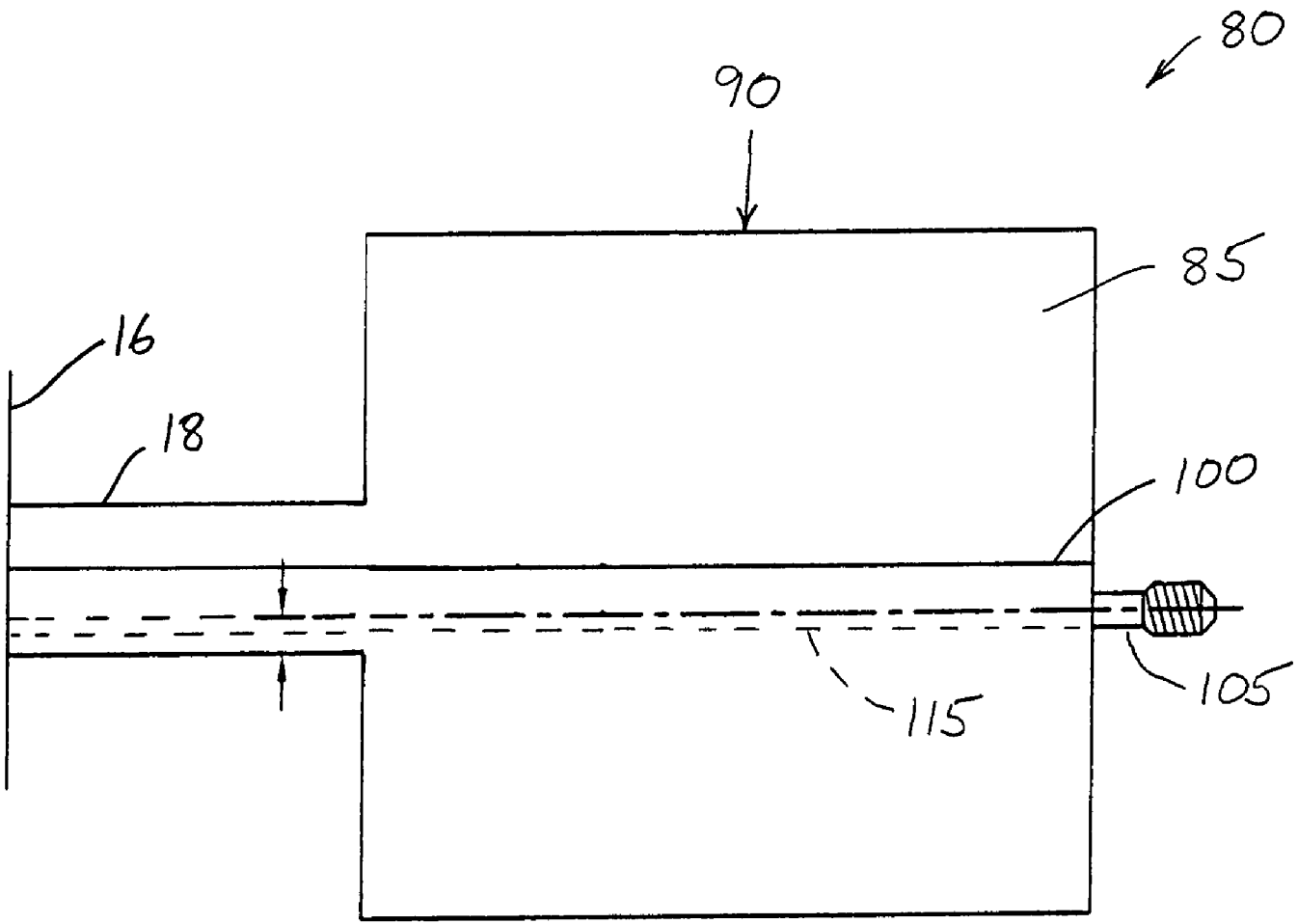
FIG. 5 is a side view of a schematic representation of an oil float assembly, as depicted in FIG. 2.
Figure 6:
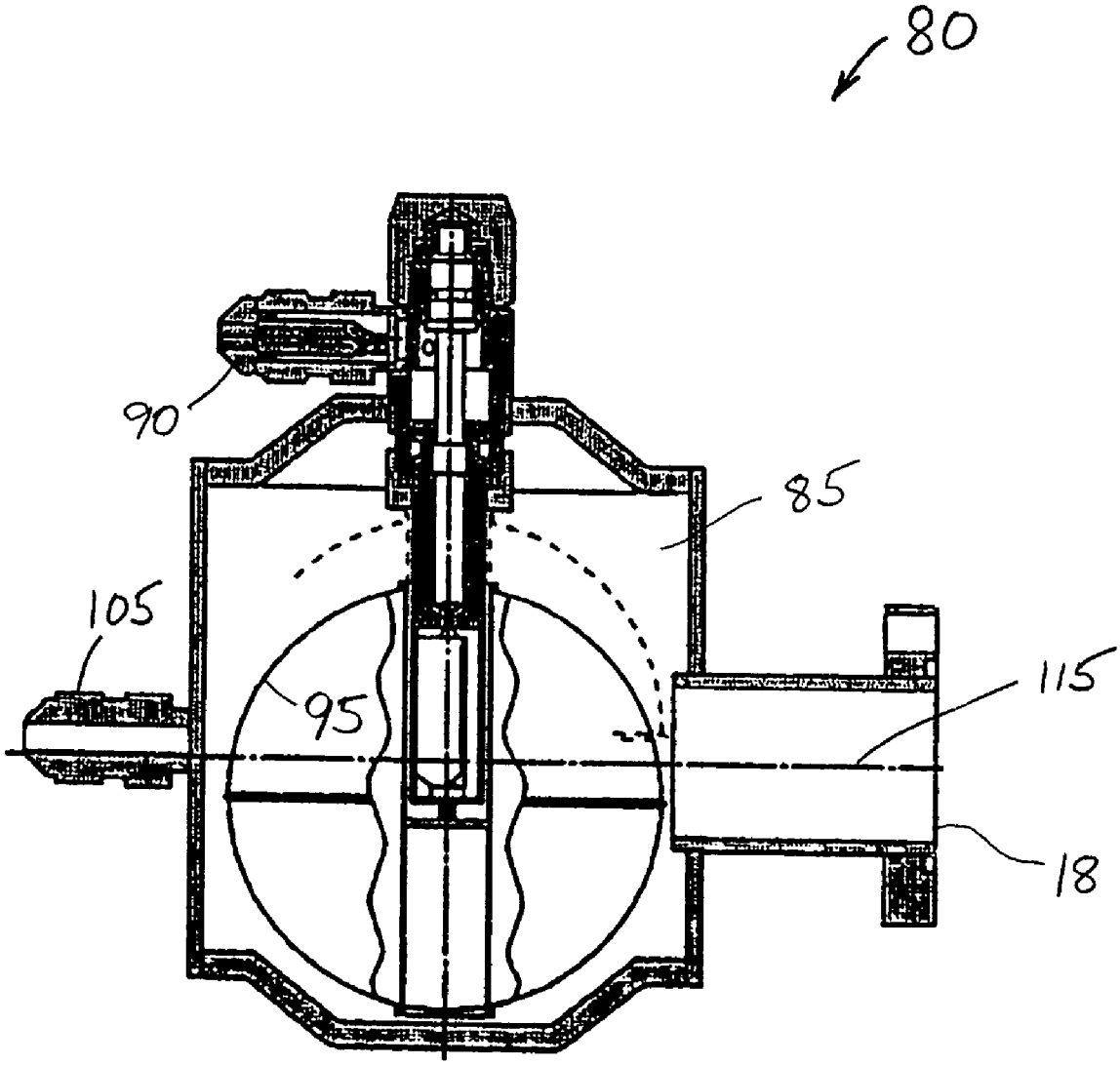
FIG. 6 is a sectional schematic view of the oil float assembly of FIG. 2.

An oil float assembly 80 is connected to each of the compressors 12 such that oil flowing from the distribution header 75 flows into one of the float assemblies 80 before entering the compressor 12. Referring to FIGS. 2, 5, and 6, the oil float assembly 80 includes a float space 85 that receives and holds a quantity of oil. The float space 85 is in fluid communication with the compressor housing 16 to allow oil to flow from the float space 85 into or out of the compressor housing 16. The oil also flows into the sight glass 18 to allow for a visual inspection of the quantity of oil within the compressor housing 16.

Some constructions may form a float assembly and compressor housing as a single component. In addition, to achieve the most efficient function, the float space 85 and the compressor housing 16 should operate as a substantially continuous volume that contains oil. Thus, if oil is drawn from the float space or added to the float space it should also be considered added or drawn from the compressor housing 16. A fill port 90 provides fluid communication between the oil distribution header 75 and the float space 85. The float assembly 80 includes a ball 95 that moves between an open position and a closed position to selectively open and close the fill port 90. When the oil level rises to a predetermined high-oil level, the float closes the fill port and inhibits the flow of additional oil into the float space 85. In preferred constructions, oil continuously flows into the float space 85 during operation of the refrigeration system 11. A drain port 105 provides fluid communication between the float assembly 80 and a drain header 110. The drain port 105 is positioned to allow for the removal of oil from the compressor housing 16 and the float space 85 when the oil level exceeds a predetermined low oil level 115. For example, in one construction illustrated in FIG. 5, the level at which oil is to be removed is set at three-eighths of a sight glass 18, as recommended by many compressor vendors. In this construction, the drain port 105 is positioned at the three-eighths level such that oil above three-eighths drains from the float assembly 80.

With reference to FIG. 1, a pump 120 draws oil from the drain header 110 and pumps it to the oil reservoir 45 for reuse in the system. In preferred constructions, the pump 120 is a hermetically sealed pump 120 that is operable to pump both refrigerant and oil. Of course other constructions may employ other types of pumps if desired.

A refrigerant header 125 collects returning refrigerant and oil from the refrigeration system 11 and directs the refrigerant vapor to the various compressors 12 for recompression. The refrigerant header 125 includes an elbow 130, or "dip pocket," which collects excess liquid refrigerant and oil that may flow through the refrigeration system 11 under certain operating conditions. A drain line 135 connects the refrigerant header 125 to the drain header 110 to allow the pump 120 to remove the refrigerant and oil before the refrigerant and oil enters and damages one or more of the compressors 12. The drain line 135 extends from the dip pocket 130 at a certain distance above the bottom of the tube to drain the excess oil and/or refrigerant from the system, while still leaving sediment for later removal.

In operation, the refrigeration system 11 operates as is well known in the art. After the refrigerant is evaporated within the refrigeration system 11 the refrigerant collects in the refrigerant header 125. As mentioned, during some operating conditions it is possible for liquid refrigerant or oil to reach the refrigerant header 125. If this occurs the liquid refrigerant and the oil collect in the dip pocket 130. One or more of the compressors 12 operates as required by the system to provide compressed refrigerant. The use of multiple compressors 12 allows for a greater variation in capacity for the refrigeration system 11. For example, multiple compressors 12 having multiple sizes (e.g., horsepower, output, etc.) allow for more fine adjustment of the output by allowing individual compressors 12 to start and stop when required by load.

The operating compressor or compressors 12 draw refrigerant from the refrigerant header 125 and draw oil from the float assembly 80. The refrigerant and oil mix and are compressed by the compressor 12. The oil-refrigerant mixture then flows to a discharge header 20 and to the oil separator 25. The oil separator 25 separates the oil from the refrigerant, directs the refrigerant into the refrigeration system 11, and directs the oil to the oil reservoir 45. As the oil flows to the oil reservoir 45, it passes through the pre-filter 40 to filter any large particulate matter that may be present.

The oil flows into the oil reservoir 45 where it is stored until required. As oil collects in the reservoir 45, it is possible for the pressure to increase to a level that increases the oil level regulated by the oil float assembly 80 above the manufacturers' recommended oil level in the compressor 12. If the pressure differential between the oil reservoir 45 and the refrigerant header 125 exceeds a predetermined value, the differential check valve 60 opens to reduce the pressure within the oil reservoir 45.

Oil from the reservoir 45 flows through the oil filter 70 and into the float assemblies 80 so long as the oil level is below the high-oil level 100. If the oil level reaches the high-oil level 100, the float assembly 80 closes the fill port 90 and inhibits additional flow into the float assembly 80. If the compressor 12 is operating, oil is drawn from the float assembly 80 and used, thus reducing the oil level within the float assembly 80. In addition, even during periods when the compressor 12 is not running, oil flows out of the float assembly 80 via the drain port 105. The position of the drain port 105 is such that the oil level cannot be reduced below a low-oil level 115 simply by allowing oil to drain out of the float space 85 via the drain port 105.

Oil that drains via the drain port 105 collects in the drain header 110 and is pumped by the pump 120 back to the oil reservoir 45. Thus, the present oil system assures that oil is constantly flowing through the system and is constantly filtered during pump operation. In addition, the system not only controls the minimum oil level within the compressor 12 but also controls the maximum oil level within each compressor 12. The system functions regardless of the size of the compressor 12 and functions when different size compressors 12 are used together.

While it is envisioned that the pump 120 would operate continuously to constantly filter and move oil, other constructions may employ a pump that is cycled periodically or that operates based on requirements of the system (e.g., pressure, flow rates, temperature, volume, levels, and the like).

Figure 3:
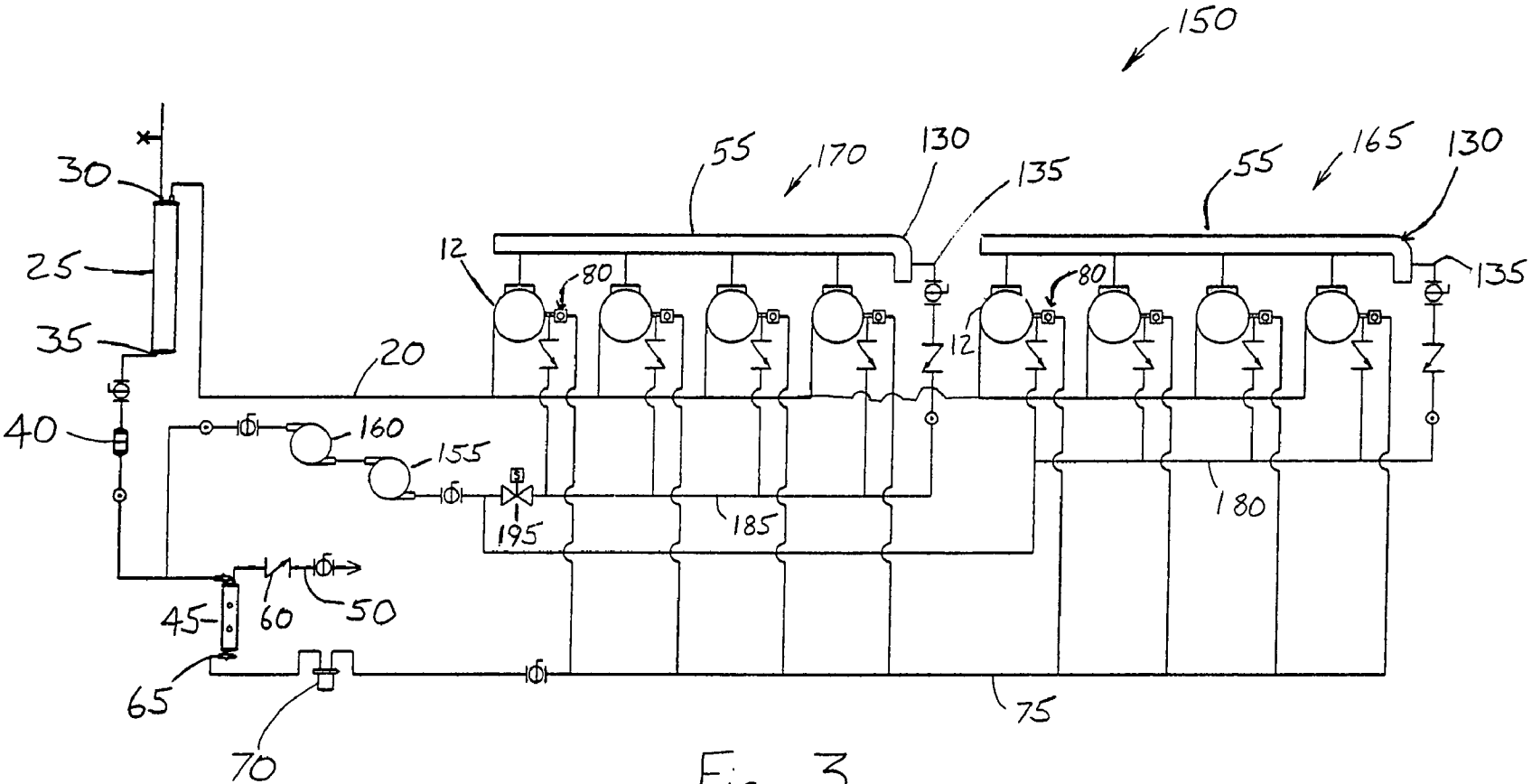
FIG. 3 is a schematic representation of an oil system with split suction.

It should also be noted that FIGS. 1, 3 and 4, illustrate the oil system 10 as including one or more check valves to inhibit back flow into any compressor 12 or suction line if there are any compressor problems. The oil system 10 also utilizes isolation valves for servicing components within the system.

FIG. 3 illustrates another construction of a refrigeration system 150 in which the difference in pressure between the oil reservoir 45 and the lower pressure oil header 180 is greater than that of the system of FIGS. 1 and 4. Rather than using a single pump 120 to pump oil from the float assemblies 80 of FIG. 3, the system 150 employs two pumps 155, 160 in series. Each pump 155, 160 is capable of discharging a flow of oil at a pressure that is a predetermined value above the intake pressure of that oil. For example, the illustrated system has an oil reservoir pressure that is 60 pounds per square inch (psi) above the low pressure oil header 180. Each pump 155, 160 is capable of discharging oil at a pressure that is 35 psi higher than the intake pressure. Thus, the first pump 155 discharges oil at 35 psi. The second pump 160 draws in oil at 35 psi and discharges oil at 70 psi. In this way, the oil system 150 is able to exceed the pressure required to flow oil to the oil reservoir 45.

The system of FIG. 3 includes two substantially independent banks of compressors 165, 170 that can be operated together or independent of one another. Each bank of compressors 165, 170 discharges compressed oil-refrigerant to a common discharge header 20. From the header 20, the system operates as was described with regard to the system of FIGS. 1 and 4.

Each bank of compressors 165, 170 also includes a low pressure oil header 180 and a high pressure oil header 185 that collect oil from the drain port 105 of the float assemblies 80 coupled to the compressors 12 of the particular bank 165, 170. Each of the headers 180, 185 directs the collected oil to the intake of the first pump 155. From the pumps, 155, 160 the oil system 150 is substantially similar to the system of FIGS. 1 and 4. As a result of the difference in oil pressures in the headers 180, 185, the oil from the high pressure oil header 185 is periodically isolated to allow oil to be removed from the low pressure oil header 180. To accomplish this, a solenoid valve 195 is positioned in the high pressure oil header 185. When the solenoid valve 195 is closed, oil cannot flow from the high pressure header 185 associated with the solenoid valve 195 to the pumps 155,160.

Although the invention has been described in detail with reference to certain described constructions, variations and modifications exist within the scope and spirit of the invention.

What is claimed is:

1. A refrigeration system comprising:

a compressor having a compressor housing an operable to compress a flow of refrigerant;

a pump operable to provide a flow of oil to the compressor, a portion of the oil mixing with the flow of refrigerant and the remainder of the oil flowing into the compressor housing;

a valve movable between an open position and a closed position, when in the closed position, the valve being operable to inhibit the addition of oil above a predetermined level within the housing;

a suction header in fluid communication with the compressor and operable to provide the flow of refrigerant to the compressor; and a dip pocket providing a fluid communication path between the suction header and the oil pump that bypasses the compressor.

2. The refrigeration system of claim 1, wherein the pump draws oil from the compressor housing.

3. The refrigeration system of claim 1, wherein the valve includes a float operable to close the valve when the oil exceeds the predetermined level.

4. The refrigeration system of claim 1, further comprising a drain port positioned to continuously drain oil from the compressor housing when the oil level is above a second predetermined level.

5. The refrigeration system of claim 1, further comprising an oil filter, wherein th pump draws oil from the compressor continuously and directs the oil through the oil filter to provide oil filtration.

6. A refrigeration system comprising:

a plurality of compressors operable to compress a flow of refrigerant, each compressor including a housing and receiving a flow of oil;

a plurality valves, each in fluid communication with one of the compressors and defining a float space, each valve operable to inhibit the addition of oil above a first predetermined level within the float space;

a pump in fluid communication with each of the valves and operable to pump oil out of each of the float spaces;

a plurality of drain ports, each drain port in fluid communication with one of the float spaces and operable to continuously drain oil from the float space when the oil level exceeds a second predetermined level within the float space;

a suction header in fluid communication with each of the plurality of compressors and operable to provide the flow of refrigerant to the compressor; and a dip pocket providing a fluid communication path between the suction header and the oil pump that bypasses the plurality of compressors.

7. The refrigeration system of claim 6, wherein each valve includes a float operabler to close the valve when the oil level in the associated float space exceeds the first predetermined level.

8. The refrigeration system of claim 6, wherein the second predetermined level is below the first predetermined level.

9. The refrigeration system of claim 6, further comprising an oil filter, wherein the pump draws oil from the plurality of float spaces continuously and directs the oil through the oil filter to provide oil filtration.

10. A refrigeration system comprising:

a pump operable to receive a flow oil and deliver a flow of oil to an oil header;

a plurality of compressors, each compressor including a housing and operable to draw refrigerant from a suction header and to draw oil from the oil header, the compressor discharging a high-pressure flow of an oil-refrigerant mixture;

an oil separator receiving the flow of the oil-refrigerant mixture and operable to separate the flow into an oil flow stream and a refrigerant flow stream;

the refrigerant flow stream flowing to an evaporator to cool a space;

the flow of oil flowing to an oil reservoir for delivery to the oil header;

a plurality of valves including a float space, each valve associated with one of the compressors and operable to inhibit a flow of oil into the float space when an oil level within the float space exceeds a first predetermined level;

a suction header in fluid communication with each of the plurality of compressors and operable to provide the flow of refrigerant to the compressor; and a dip pocket providing a fluid communication path between the suction header and the oil pump that bypasses the plurality of compressors.

11. The refrigeration system of claim 10, wherein each valve includes a float operable to close the valve when the oil level in the associated float space exceeds the first predetermined level.

12. The refrigeration system of claim 10, further comprising a plurality of drain ports, each associated with a valve and positioned to continuously drain oil from the float space when the oil is above a second predetermined level.

13. The refrigeration system of claim 10, further comprising an oil filter, wherein the pump draws oil from the float spaces continuously and directs the oil through the oil filter to provide oil filtration.

* * * * *

UNITED STATES PATENT AND TRADEMARK OFFICE

CERTIFICATE OF CORRECTION

PATENT NO. : 7,231,783 B2
APPLICATION NO. : 11/211310
DATED : August 25, 2005
INVENTOR(S) : Steve L. Esslinger et al.

It is certified that error appears in the above-identified patent and that said Letters Patent is hereby corrected as shown below:

Col. 6 Claim 1, line 50, “an” should be --and--.
Col. 7 Claim 3, line 2, insert --level-- after --oil--.
Col. 7 Claim 5, line 9, “th pump” should be --the pump--.
Col. 7 Claim 6, line 16, after “each” insert --valve--.
Col. 7 Claim 7, line 34, “operabler” should be --operable--.

Signed and Sealed this

Fourth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,231,783 B2
APPLICATION NO. : 11/211310
DATED : June 19, 2007
INVENTOR(S) : Steve L. Esslinger et al.

It is certified that error appears in the above-identified patent and that said Letters Patent is hereby corrected as shown below:

Col. 6 Claim 1, line 50, “an” should be --and--.
Col. 7 Claim 3, line 2, insert --level-- after --oil--.
Col. 7 Claim 5, line 9, “th pump” should be --the pump--.
Col. 7 Claim 6, line 16, after “each” insert --valve--.
Col. 7 Claim 7, line 34, “operabler” should be --operable--.

This certificate supersedes the Certificate of Correction issued March 4, 2008.

Signed and Sealed this

First Day of April, 2008

JON W. DUDAS
*Director of the United States Patent and Trademark Office*